US006347469B1

(12) United States Patent
Huellinghoff et al.

(10) Patent No.: US 6,347,469 B1
(45) Date of Patent: Feb. 19, 2002

(54) MAGNETIC MESSAGE DISPLAY AND METHOD OF SELECTIVELY FRAMING MESSAGES OF SAME

(75) Inventors: Roberta Elizabeth Huellinghoff, Villa Ridge; Darryl Haddox, Washington; John Melton, Union, all of MO (US)

(73) Assignee: Magnet LLC, Washington, MO (US)

( * ) Notice: Subject to any disclaimer, the term of this patent is extended or adjusted under 35 U.S.C. 154(b) by 0 days.

(21) Appl. No.: 09/532,203

(22) Filed: Mar. 22, 2000

(51) Int. Cl.[7] ..... G09F 7/04
(52) U.S. Cl. ..... 40/600; 40/711; 40/621
(58) Field of Search ..... 40/674, 711, 621, 40/773, 124.04, 600

(56) References Cited

U.S. PATENT DOCUMENTS

| | | | | | |
|---|---|---|---|---|---|
| 3,187,449 | A | | 6/1965 | Longo et al. | |
| 3,298,124 | A | | 1/1967 | Jahn | |
| 3,769,720 | A | * | 11/1973 | Terrones | 35/7 A |
| 3,786,584 | A | | 1/1974 | Holson | |
| 3,839,130 | A | | 10/1974 | Dean et al. | |
| 4,006,537 | A | * | 2/1977 | Valentine | 40/142 A |
| 4,312,691 | A | * | 1/1982 | Rosenbloom, Jr. et al. | 156/267 |
| 4,817,320 | A | * | 4/1989 | Fraynd | 40/621 |
| 4,846,689 | A | * | 7/1989 | Day | 434/168 |
| 5,495,686 | A | | 3/1996 | Millard et al. | |
| 5,666,712 | A | * | 9/1997 | Cvetkov | 40/711 |
| 5,737,862 | A | * | 4/1998 | Cooper et al. | 40/606 |
| 5,918,400 | A | | 7/1999 | Schonberger | |
| 5,994,990 | A | * | 11/1999 | Ogikubo | 335/285 |
| 6,153,280 | A | * | 11/2000 | Uffmann | 428/43 |
| 6,159,577 | A | * | 12/2000 | Pynenburg et al. | 428/99 |

* cited by examiner

*Primary Examiner*—Lynne H. Browne
*Assistant Examiner*—Kenn Thompson
(74) *Attorney, Agent, or Firm*—Howell & Haferkamp, LC

(57) ABSTRACT

A magnetic display comprises a message sheet made of a magnetic sheet material having first and second opposite faces. The message sheet has a message section and a frame section each having first and second opposite faces. The first face of the message section has a plurality of discrete regions. Each discrete region has a printed message therein. The frame section is separable from the message section and includes a frame member. The frame member comprises a peripheral region having an outer edge and an inner edge. The inner edge defines a window through the frame section. The frame member has first and second opposite faces. The frame member and the message section are magnetically attracted to one another in a manner so that the frame member magnetically bonds to the message section when the second face of the frame member is placed against the first face of the message section. The frame member is adapted to be separated from the rest of the message sheet and placed on the message section in a manner so that the window aligns with a first one of the plurality of printed messages and so that the peripheral region of the frame member circumscribes the first one of the plurality of printed messages.

16 Claims, 2 Drawing Sheets

2
16
46a
44
44
46b
44
46c
44
48c
48a
48b
44
24
44
46f
46d
44
46e
48f
48d
48e
30
34
46h
44
46i
46g
44
44
48g
48h
48i
46j
48k
48l
18
44
44
48j
48k
48l
44
62
50
54
32
52
58
70
40
72
60
56

2

MAGNETIC MESSAGE DISPLAY AND METHOD OF SELECTIVELY FRAMING MESSAGES OF SAME

BACKGROUND OF THE INVENTION

This invention relates generally to magnetic message displays and methods of selectively framing messages on a message sheet of the display with a framing member magnetically attracted to the message sheet.

A conventional message display comprises a message board and a separate frame piece magnetically attracted to the message board for retaining the frame piece on the message board. The message board includes an outer face having a plurality of discrete regions. Each region has a different drawing and/or word message thereon. The frame piece has a window therethrough. The window is slightly larger than any one of the discrete regions so that the frame piece circumscribes the message of any one of the discrete regions when the frame piece is placed on the message board with the window in alignment with such discrete region. The frame piece may have a printed message portion thereon which combines with the drawing and/or word message of any of the discrete regions to form a complete message.

The message board is typically of a magnetic sheet or metallic plate and the frame piece is magnetized to magnetically attach to the magnetic sheet or metallic plate. The message board is formed with the messages printed thereon, and the frame piece is separately formed with the message portion printed thereon. A disadvantage of such a conventional message display is the cost to separately manufacture the two pieces of the display.

SUMMARY OF THE INVENTION

Among the advantages of the present invention may be noted: the provision of an improved message display and framing method; the provision of such a message display and framing method having a message board and frame piece formed together; the provision of such a message display and framing method in which the message board and frame piece are formed together from a single sheet of material.

In general, a magnetic display comprises a message sheet made of a magnetic sheet material having first and second opposite faces. The message sheet has a message section and a frame section. The message section and the frame section each have first and second opposite faces. The first face of the message section and the first face of the frame section are each part of the first face of the message sheet. The first face of the message section has a plurality of discrete regions. Each discrete region has a printed message therein so that the first face of the message section includes a plurality of printed messages. The frame section is separable from the message section and includes a frame member. The frame member comprises a peripheral region having an outer edge and an inner edge. The inner edge defines a window through the frame section. The peripheral region completely circumscribes the window. The frame member has first and second opposite faces. The first face of the frame member is at least a part of the first face of the frame section. The frame member and the message section are magnetically attracted to one another in a manner so that the frame member magnetically bonds to the message section when the second face of the frame member is placed against the first face of the message section. The frame member is adapted to be separated from the rest of the message sheet and placed on the message section in a manner so that the window aligns with a first one of the plurality of printed messages and so that the peripheral region of the frame member circumscribes the first one of the plurality of printed messages.

Another aspect of the present invention is a method for selectively framing one of a plurality of messages on a message sheet. The method comprises separating the frame section from the message section, and placing the frame member on the message section in a manner so that the window of the frame member aligns with a first one of the plurality of printed messages and so that the peripheral region of the frame member circumscribes the first one of the plurality of printed messages.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
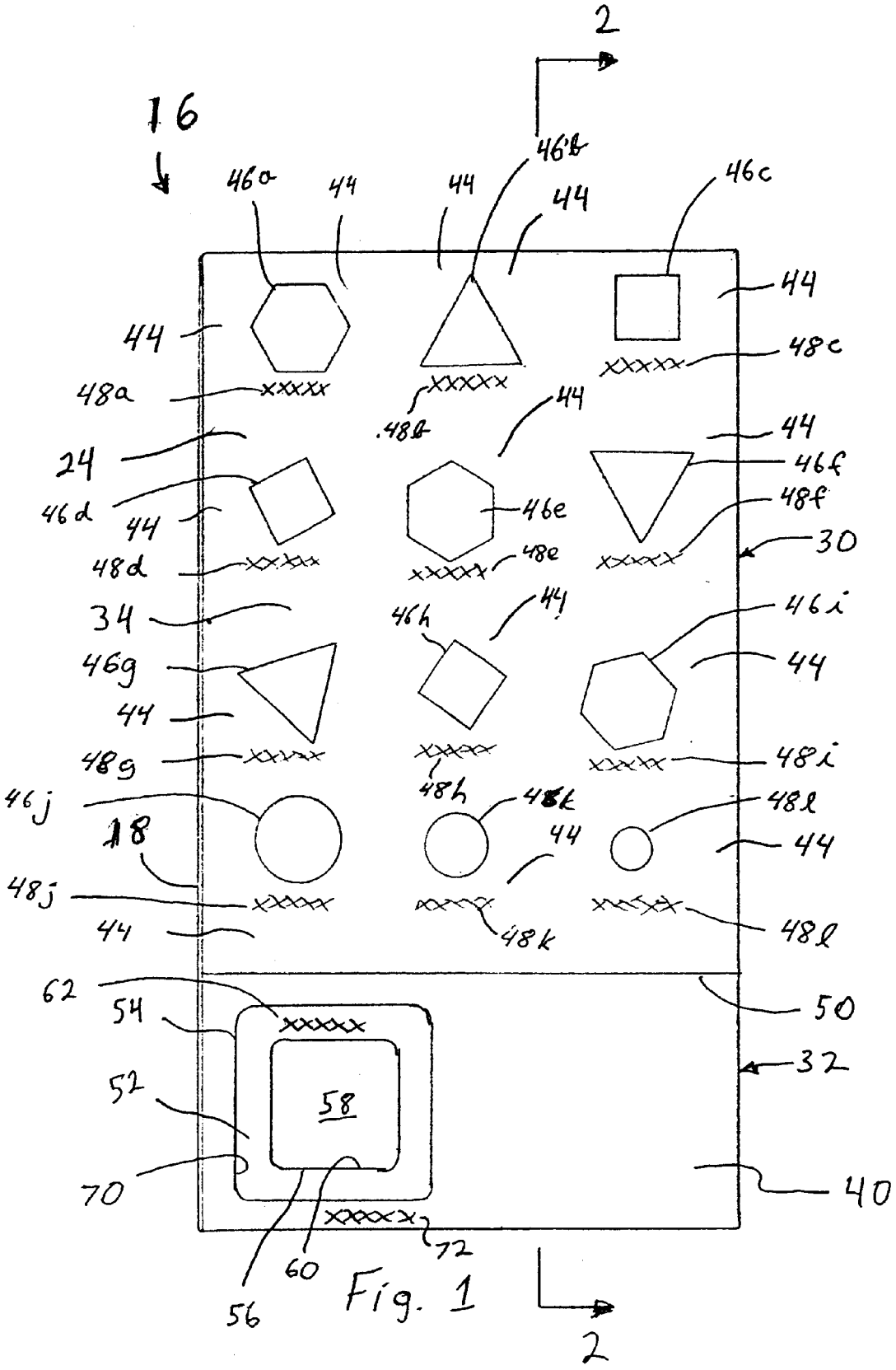
FIG. 1 is a top plan view of magnetic display of the present invention having a message section and a detachable frame section.
Figure 2:
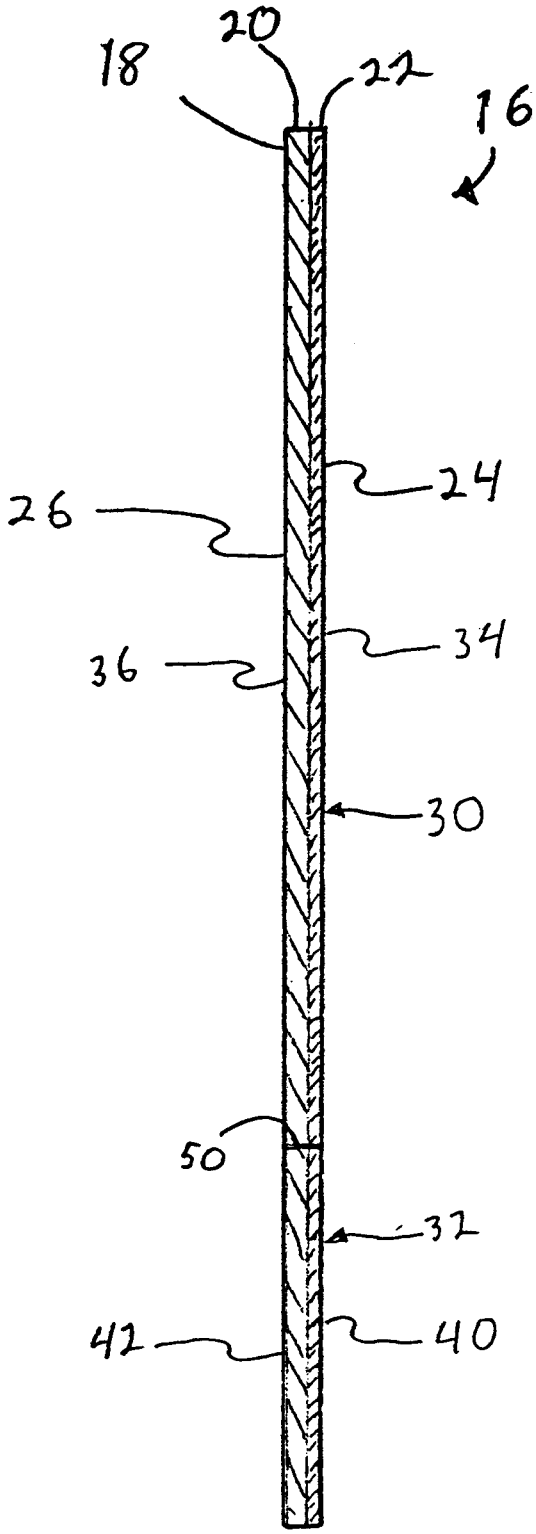
FIG. 2 is a cross-sectional view taken along the plane of line 2—2 of FIG. 1.

Referring first to FIGS. 1 and 2, a magnetic display of the present invention is generally indicated in its entirety be reference numeral 16. The magnetic display comprises a message sheet 18 made of a magnetic sheet material. The magnetic sheet material is preferably a flexible laminate having a magnetic layer, generally indicated at 20, and a printable layer, generally indicated at 22, and may be of any suitable material such as white vinyl magnetic laminated material commercially available from Magnum Magnetics Corporation, Marietta, Ohio. The message sheet 18 has first and second opposite faces 24, 26. The message sheet has a message section, generally indicated at 30, and a frame section, generally indicated at 32. The message section 30 has first and second opposite faces 34, 36 and the frame section 32 has first and second opposite faces 40, 42. The first face 34 of the message section 30 and the first face 40 of the frame section 32 are each part of the first face 24 of the message sheet 18. Likewise, the second face 36 of the message section 30 and the second face 42 of the frame section 32 are each preferably part of the second face 24 of the message sheet 18. As shown in FIG. 1, the first face 34 of the message section 30 has a plurality of discrete regions 44. Each discrete region 44 has a printed message therein so that the first face of the message section includes a plurality of printed messages. Preferably, each printed message includes a pictorial message portion and a worded message portion. The pictorial message portions are indicated at 46*a–l*, and the worded message portions are indicated at 48*a–l*. Although shown as geometric shapes for ease of drawing, it is to be understood that the pictorial message portions 46*a–l* are preferably photographs, pictures, caricatures, cartoons, or other drawings. The worded message portions 48*a–l* may each be a single word or short phrase. Preferably, all of the pictorial message portions 46*a–l* are different and all of the worded message portions 48*a–l* are different. Also preferably, the theme of each worded message portion 48*a–l* matches the theme of its corresponding pictorial message portion 46*a–l*. For example, each worded message portion may be a caption for its corresponding pictorial message portion.

The message sheet 18 includes a line of weakness 50 for facilitating separation of the frame section 32 from the message section 30. Preferably, the line of weakness 50 is a kiss cut, perforated line, or any other suitable type of die cut. The frame section 32 includes a punch-out frame member 52. The frame member 52 is formed by concentric outer and inner lines of weakness 54, 56. Preferably, the outer and inner lines of weakness 54, 56 are formed by the same manner and at the same time as the line of weakness 50. The outer line of weakness 54 defines an outer edge of the frame member 52 and the inner line of weakness 56 defines an inner edge of the frame member. The frame member 52 may be punched out from the rest of the frame section 32 by separating the frame member at the outer line of weakness 54. The frame member 52 circumscribes a small punch-out portion 58 which is separable from the frame member via the inner line of weakness 56. The punch-out portion 58 may be separated and discarded. The inner edge of the frame member 52 defines a window 60 therethrough. The frame member 52 comprises a peripheral region completely circumscribing the window. The frame member 52 has first and second opposite faces. The first face of the frame member is at least a part of the first face 40 of the frame section 32.

The frame member 52 and the message section 30 are magnetically attracted to one another in a manner so that the frame member magnetically bonds to the message section when the second face of the frame member is placed against the first face 34 of the message section 30. Upon separation from the rest of the frame section 32, the frame member 52 may be placed on the message section 30 in a manner so that the window 60 aligns with any one of the plurality of printed messages and so that the peripheral region of the frame member circumscribes such printed message. Preferably, the frame member 52 further includes a worded message portion 62 which corresponds with the worded message portions 48*a–l* of the message section 30. For example, the worded message portion 62 of the frame member 52 may be a phrase which when combined with any one of the worded message portions 48*a–l* of the message section 30 forms a complete sentence. Alternatively, the worded message portion 62 of the frame member 52 may be a question answered by any one of the worded message portions 48*a–l* of the message section 30.

Although the message sheet 18 is preferably formed with the line of weakness 50, it is to be understood that the message sheet may be formed without any line of weakness without departing from the scope of this invention. In addition to defining the outer edge of the frame member 52, the outer line of weakness 54 defines an opening 70 through the message sheet once the frame member is removed from the opening. A user may place a photograph against the second face 26 of the message sheet 18 and in alignment with the opening 70 so that at least part of the photograph is visible through the opening. The frame member 52 may be placed over the photograph to frame the photograph in the same manner it is placed over any one of the discrete regions to frame one of the messages. A caption or other worded message 72 intended to correspond to the photograph may be printed on the first face 24 of the message sheet 18 and adjacent the opening 70.

To use the magnetic display 16, the frame member 52 is separated from the rest of the message sheet 18. The message section 30 is preferably placed against a generally flat metallic surface, such as the surface of a refrigerator or file cabinet (not shown), and magnetically held against such surface by the magnetic layer 20. Alternatively, the message section 30 could be bonded to a flat surface (e.g., a wall or door) via tape or adhesive. The frame member 52 is then placed on one of the discrete regions 44 of the message section 30 in a manner so that the window 60 of the frame member aligns with the pictorial message portion and worded message portion of the printed message associated with such discrete region (e.g., pictorial message portion 46*a* and worded message portion 48*a*), and so that the peripheral region of the frame member completely circumscribes both the message portion and worded message portion of such printed message. The magnetic attraction between the frame member 52 and message section 30 keeps the frame member on the message section. To frame a different message, the frame member 52 is moved to a different discrete region 44 of the message section 30 in a manner so that the window 60 of the frame member aligns with the pictorial message portion and worded message portion of the different discrete region (e.g., pictorial message portion 46*e* and worded message portion 48*e*), and so that the peripheral region of the frame member completely circumscribes both the message portion and worded message portion of the different discrete region. As discussed above, the frame member 52 may be placed over the opening 70 to frame a photograph placed therein. Thus, any one of a plurality of messages may be conveyed merely by moving the frame member 52.

In view of the above, it will be seen that the several objects of the invention are achieved and other advantageous results attained.

As various changes could be made in the above constructions or methods without departing from the scope of the invention, it is intended that all matter contained in the above description or shown in the accompanying drawings shall be interpreted as illustrative and not in a limiting sense.

What is claimed is:

1. A method of selectively framing one of a plurality of messages on a message sheet, the method comprising:

providing a message sheet made of a magnetic sheet material having first and second opposite faces, the message sheet having a message section and a frame section, the message section and the frame section each having first and second opposite faces, the first face of the message section and the first face of the frame section each being part of the first face of the message sheet, the first face of the message section having a plurality of discrete regions, each discrete region having a printed message therein so that the first face of the message section includes a plurality of printed messages, the frame section being separable from the message section and including a frame member, the frame member comprising a peripheral region having an outer edge and an inner edge, the inner edge defining a window through the frame section, the peripheral region completely circumscribing the window, the frame member having first and second opposite faces, the first face of the frame member being at least a part of the first face of the frame section, the frame member and the message section being magnetically attracted to one another in a manner so that the frame member magnetically bonds to the message section when the second face of the frame member is placed against the first face of the message section;

separating the frame section from the rest of the message sheet;

placing the frame member on the message section in a manner so that the window of the frame member aligns with a first one of the plurality of printed messages and so that the peripheral region of the frame member circumscribes the first one of the plurality of printed messages.

2. A method as set forth in claim 1 further comprising moving the frame member into alignment with a second one of the plurality of printed messages so that the peripheral region of the frame member circumscribes the second one of the plurality of printed messages.

3. A method as set forth in claim 1 wherein all of the plurality of printed messages are different.

4. A method as set forth in claim 3 wherein each of the plurality of printed messages comprises a pictorial message portion.

5. A method as set forth in claim 3 wherein each of the plurality of printed messages comprises a worded message portion.

6. A method as set forth in claim 3 wherein each of the plurality of printed messages comprises a pictorial message portion and a worded message portion.

7. A method as set forth in claim 6 wherein the first face of the frame member includes a worded message portion, the worded message portion of the frame member combining with the message portions of each of the plurality of printed messages in a manner so that the message portion of the frame member in combination with the message portions of any of the plurality of printed messages conveys a complete message.

8. A method as set forth in claim 1 wherein the message sheet includes at least one line of weakness in the magnetic sheet material defining the inner edge of the frame member, the lines of weakness circumscribing a non-frame portion of the frame section, the method further comprising separating the non-frame portion of the frame section from the frame member to form the window of the frame section.

9. A method as set forth in claim 1 wherein the message sheet further includes at least one line of weakness in the magnetic sheet defining the outer edge of the frame member and defining an opening through the message sheet when the frame member is separated from the magnetic sheet, the method further comprising placing a photograph against the second face of the magnetic sheet and in alignment with the opening so that at least a part of the photograph is visible through the opening.

10. A magnetic display comprising a message sheet made of a magnetic sheet material having first and second opposite faces, the message sheet having a message section and a frame section, the message section and the frame section each having first and second opposite faces, the first face of the message section and the first face of the frame section each being part of the first face of the message sheet, the first face of the message section having a plurality of discrete regions, each discrete region having a printed message therein so that the first face of the message section includes a plurality of printed messages, the frame section being separable from the message section and including a frame member, the frame member comprising a peripheral region having an outer edge and an inner edge, the inner edge defining a window through the frame section, the peripheral region completely circumscribing the window, the frame member having first and second opposite faces, the first face of the frame member being at least a part of the first face of the frame section, the frame member and the message section being magnetically attracted to one another in a manner so that the frame member magnetically bonds to the message section when the second face of the frame member is placed against the first face of the message section, the frame member being adapted to be separated from the message section and placed on the message section in a manner so that the window aligns with a first one of the plurality of printed messages and so that the peripheral region of the frame member circumscribes the first one of the plurality of printed messages.

11. A magnetic display as set forth in claim 10 wherein all of the plurality of printed messages are different.

12. A method as set forth in claim 11 wherein each of the plurality of printed messages comprises a pictorial message portion.

13. A method as set forth in claim 11 wherein each of the plurality of printed messages comprises a worded message portion.

14. A method as set forth in claim 11 wherein each of the plurality of printed messages comprises a pictorial message portion and a worded message portion.

15. A method as set forth in claim 14 wherein the first face of the frame member includes a worded message portion, the worded message portion of the frame member combining with the message portions of each of the plurality of printed messages in a manner so that the message portion of the frame member in combination with the message portions of any of the plurality of printed messages conveys a complete message.

16. A method as set forth in claim 10 wherein the message sheet includes lines of weakness in the magnetic sheet material defining the inner edge of the frame member, the lines of weakness circumscribing a non-frame portion of the frame section.

* * * * *